US008638049B2

(12) United States Patent
Yang et al.

(10) Patent No.: US 8,638,049 B2
(45) Date of Patent: Jan. 28, 2014

(54) DRIVING DEVICE, LIGHT EMITTING DIODE DRIVING DEVICE AND DRIVING METHOD

(75) Inventors: Cheng-Feng Yang, Miao-Li County (TW); Cheng-I Wu, Miao-Li County (TW); Li-Wei Mao, Miao-Li County (TW)

(73) Assignee: Chimei Innolux Corporation, Miao-Li County (TW)

( * ) Notice: Subject to any disclaimer, the term of this patent is extended or adjusted under 35 U.S.C. 154(b) by 307 days.

(21) Appl. No.: 13/042,957

(22) Filed: Mar. 8, 2011

(65) Prior Publication Data

US 2011/0221358 A1 Sep. 15, 2011

(30) Foreign Application Priority Data

Mar. 9, 2010 (TW) ..... 99106749 A

(51) Int. Cl.
*H05B 37/02* (2006.01)

(52) U.S. Cl.
USPC ..... 315/307; 315/186; 315/247; 315/287

(58) Field of Classification Search
USPC ..... 315/185 R, 186, 247, 287, 291, 294, 315/299, 300, 307
See application file for complete search history.

(56) References Cited

U.S. PATENT DOCUMENTS 7,880,404 B2 * 2/2011 Deng et al. ..... 315/291
8,143,812 B2 * 3/2012 Huang et al. ..... 315/297
2009/0085489 A1 4/2009 Chang et al.
2010/0141159 A1 * 6/2010 Shiu et al. ..... 315/185 R
2011/0032008 A1 * 2/2011 Zhao et al. ..... 327/114
2011/0316425 A1 * 12/2011 Chang et al. ..... 315/122

FOREIGN PATENT DOCUMENTS

CN 101500361 8/2009
TW I277024 3/2007
TW 200945942 11/2009

OTHER PUBLICATIONS

Taiwanese language office action dated Jul. 17, 2013.
English language translation of abstract of TW I277024 (published Mar. 21, 2007).
English language translation of abstract of TW 200945942 (published Nov. 1, 2009).
Chinese language office action dated Sep. 2, 2013.
English language translation of abstract of CN 101500361 (published Aug. 5, 2009).

* cited by examiner

*Primary Examiner* — Tung X Le
(74) *Attorney, Agent, or Firm* — McClure, Qualey & Rodack, LLP

(57) ABSTRACT

A driving device, a light emitting diode (LED) driving device and a method thereof are provided. The driving device includes a driving unit and a plurality of selection units. The driving unit produces a driving signal to drive a light emitting diode. The selection units are coupled to the driving unit and respectively correspond to a current value. The driving unit selects one of the selection units according a first pulse width modulation (PWM) signal. The current value corresponding to the selected selection unit is taken as the current value of the driving signal. The driving unit generates a duty cycle of a second PWM signal according to the duty cycle of the first PWM signal to serve as a duty cycle of the driving signal. In this way, power consumption of the LED is reduced.

15 Claims, 7 Drawing Sheets

DRIVING DEVICE, LIGHT EMITTING DIODE DRIVING DEVICE AND DRIVING METHOD

CROSS-REFERENCE TO RELATED APPLICATION

This application claims the priority benefit of Taiwan application serial no. 99106749, filed on Mar. 9, 2010. The entirety of the above-mentioned patent application is hereby incorporated by reference herein and made a part of this specification.

BACKGROUND

1. Field of the Invention

The invention relates to a driving device. Particularly, the invention relates to a light emitting diode (LED) driving device and a driving method thereof.

2. Description of Related Art

Since a liquid crystal display (LCD) has advantages of lightness, thinness, shortness, smallness, low power consumption and no irradiation, it is widely applied in portable electronic devices such as personal digital assistants (PDAs), notebooks (NBs) and digital cameras. Since a LCD panel of the LCD cannot emit light itself, a backlight module has to be disposed under the LCD panel to provide a light source, so as to achieve a display function. Moreover, in order to achieve a light and thin effect, the portable electronic device generally uses a light emitting diode (LED) as the light source of the backlight module.

When the portable electronic device uses commercial power as a power supply, the backlight module can provide a brighter light source to improve a display effect of the portable electronic device without power problem. Conversely, when the portable electronic device uses a battery as the power supply, in order to ensure a longer usage time of the portable electronic device, brightness of the backlight module thereof is reduced to reduce the power consumption. Generally, adjustment of the brightness of the backlight module can be implemented by adjusting a duty cycle of a driving signal. In other words, if the duty cycle of the driving signal is 100% when the portable electronic device uses the commercial power, the duty cycle of the driving signal is 50% when the portable electronic device uses the battery. In this way, power consumption of the portable electronic device using the battery is reduced, and the usage time of the portable electronic device is prolonged.

SUMMARY OF THE INVENTION

The invention is directed to a driving device, a light emitting diode (LED) driving device and a driving method thereof, which can reduce power consumption of a LED.

The invention provides a light emitting diode (LED) driving device including a driving unit and a plurality of selection units. The driving unit produces a driving signal to drive a LED. The selection units are coupled to the driving unit and respectively correspond to different current values. The driving unit selects one of the selection units according a duty cycle of a first pulse width modulation (PWM) signal, and takes the current value corresponding to the selected selection unit as a current value of the driving signal. The driving unit generates a second PWM signal according to the duty cycle of the first PWM signal, and takes a duty cycle of the second PWM signal as a duty cycle of the driving signal, where the duty cycle of the second PWM signal is greater than or equal to the duty cycle of the first PWM signal.

In an embodiment of the invention, the LED driving device further includes a plurality of switches, and the switches are respectively coupled between the selection units and the driving unit. One of the switches is turned on according to a selecting signal, so as to select one of the selection units to electrically connect the driving unit.

In an embodiment of the invention, the driving unit obtains a current value corresponding to the selecting signal according to a look-up table, and selects one of the selecting units according to the current value corresponding to the selecting signal.

In an embodiment of the invention, the driving unit obtains a current value corresponding to the duty cycle of the first PWM signal and the duty cycle of the second PWM signal according to a look-up table or an arithmetic logical operation unit, and selects one of the selection units according to the current value corresponding to the duty cycle of the first PWM signal.

The invention provides a method for driving a light emitting diode (LED). The method includes providing a driving signal to drive a LED; providing a plurality of current values; receiving a first pulse width modulation (PWM) signal; selecting one of the current values according to a duty cycle of the first PWM signal to serve as a current value of the driving signal; generating a second PWM signal according to the duty cycle of the first PWM signal, where a duty cycle of the second PWM signal is greater than or equal to the duty cycle of the first PWM signal; and taking the duty cycle of the second PWM signal as a duty cycle of the driving signal.

In an embodiment of the invention, the step of selecting one of the current values according to the duty cycle of the first PWM signal includes generating a selecting signal according to the duty cycle of the first PWM signal, and selecting one of the current values according to the selecting signal.

In an embodiment of the invention, the step of selecting one of the current values according to the selecting signal includes obtaining a current value corresponding to the selecting signal according to a look-up table, and selecting one of the current values according to the current value corresponding to the selecting signal.

In an embodiment of the invention, the selecting signal is obtained according to a look-up table or is obtained by performing an operation on the duty cycle of the first PWM signal.

In an embodiment of the invention, the second PWM signal is obtained according to a look-up table or is obtained by performing an operation on the duty cycle of the first PWM signal.

In an embodiment of the invention, the step of selecting one of the current values according to the duty cycle of the first PWM signal comprises obtaining a current value corresponding to the duty cycle of the first PWM signal according to a look-up table, and selecting one of the current values according to the current value corresponding to the duty cycle of the first PWM signal.

The invention provides a driving device for driving at least one light emitting diode (LED). The driving device includes a pulse width modulation (PWM) unit, a signal generating unit, a selection unit and a current generating unit. The selection unit is coupled to the signal generating unit. The current generating unit is coupled to the selection unit. When a brightness of the LED is to be changed, the PWM unit receives a first PWM signal and generates a second PWM signal, and the signal generating unit also receives the first PWM signal and generates a selecting signal. Moreover, the selection unit receives the selecting signal and generates a current determining signal. The current generating unit receives the current determining signal and generates a driving current. The driving device drives the LED according to a duty cycle of the second PWM signal and the driving current.

In an embodiment of the invention, the selection units are respectively more than one resistors or registers.

In an embodiment of the invention, the PWM unit obtains the second PWM signal corresponding to the duty cycle of the first PWM signal according to a look-up table, or generates the second PWM signal by performing an operation on the duty cycle of the first PWM signal.

In an embodiment of the invention, the signal generating unit obtains the selecting signal corresponding to the duty cycle of the first PWM signal according to a look-up table, or generates the selecting signal by performing an operation on the duty cycle of the first PWM signal.

In an embodiment of the invention, a ratio of the duty cycle of the second PWM signal and the duty cycle of the first PWM signal is inversely proportional to a ratio of the driving current and a predetermined current value.

According to the above descriptions, in the driving device, the LED driving device and the driving method thereof, since when the current is decreased, the light emitting efficiency of the LED is increased, based on the method that the brightness is adjusted by adjusting the current value of the driving signal, the current required for setting the brightness can be reduced, so as to save the power consumption.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
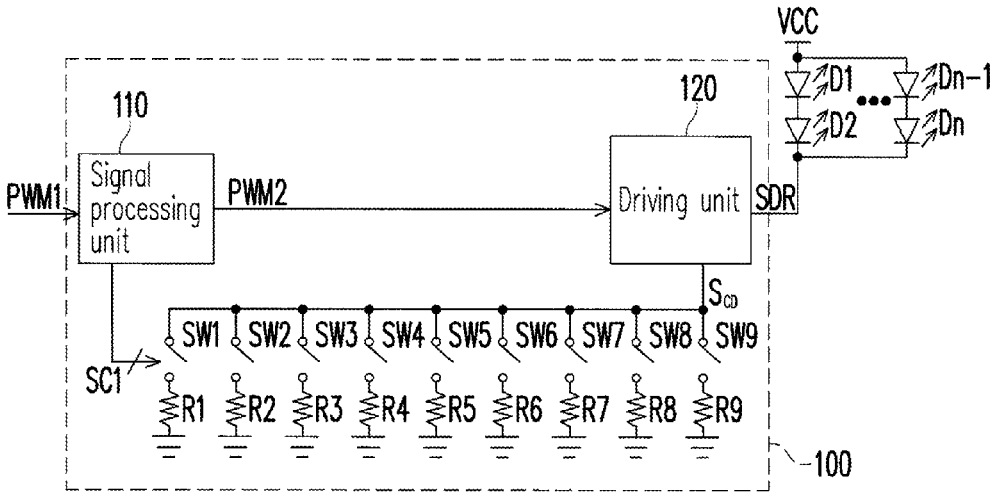
FIG. 1A is a circuit schematic diagram of a light emitting diode (LED) driving device coupled to LEDs according to a first embodiment of the invention.

FIG. 1A is a circuit schematic diagram of a light emitting diode (LED) driving device coupled to LEDs according to a first embodiment of the invention. Referring to FIG. 1A, the LED driving device 100 includes a signal processing unit 110, a driving unit 120, switches SW1-SW9 and a plurality of selection units (which are, for example, resistors R1-R9, though in other embodiments, the selection units can be a plurality of registers, which is not limited by the invention), and the LED driving device 100 can serve as a backlight module of a display. The signal processing unit 110 generates a second pulse width modulation (PWM) signal PWM2 and a selecting signal SC1 according to a first PWM signal PWM1, where the first PWM signal PWM1 can be a brightness signal transmitted from external, and a duty cycle of the second PWM signal PWM2 is greater than or equal to a duty cycle of the first PWM signal PWM1. Moreover, the signal processing unit 110 obtains the duty cycle of the second PWM signal PWM2 corresponding to the first PWM signal PWM1 and the selecting signal SC1 according to a look-up table or by performing an operation according to the duty cycle of the first PWM signal PWM1, where the operation can be performed through an arithmetic logical operation unit.

One of the switches SW1-SW9 is turned on according to the selecting signal SC1 to electrically connect one of the resistors R1-R9 to the driving unit 120, where the resistors R1-R9 are used to control a current value flowing through LEDs D1, D2, . . . , Dn, i.e. the resistors R1-R9 are used to determine a current value of a driving signal SDR, where resistances of the resistors R1-R9 are different.

The driving unit 120 receives the second PWM signal PWM2 and is electrically connected to one of the resistors R1-R9, and takes the duty cycle of the second PWM signal PWM2 as a duty cycle of the driving signal SDR, and takes a current value corresponding to the electrically connected resistor as a current value of the driving signal SDR, and accordingly generates the driving signal SDR.

On the other hand, one of the switches SW1-SW9 is turned on according to the selecting signal SC1 to electrically connect one of the resistors R1-R9 to the driving unit 120, and the resistor coupled to the driving unit 120 correspondingly generates a current determining signal $S_{CD}$. The driving unit 120 generates a driving current (i.e. determines a current value of the driving signal SDR) according to the current determining signal $S_{CD}$, and now the driving unit 120 can be regarded as a current generating unit. Moreover, the driving unit 120 determines whether or not to provide the driving current to the LEDs D1, D2, . . . , Dn according to the duty cycle of the second PWM signal PWM2, and accordingly generates the driving signal SDR. The LEDs D1, D2, . . . , Dn determine to emit light or otherwise according to a voltage difference between a system voltage VCC and the driving signal SDR, i.e. the LEDs D1, D2, . . . , Dn are driven by the driving signal SDR to emit light or otherwise.

Figure 1B:
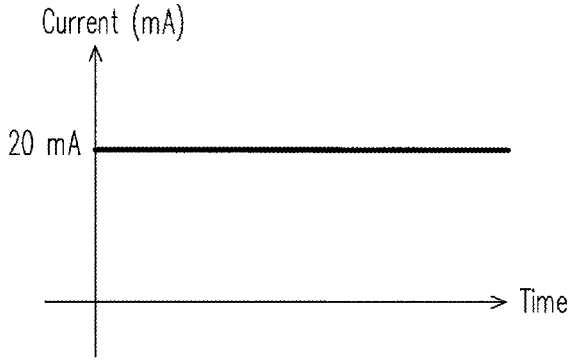
FIG. 1B and FIG. 1C are waveform diagrams of duty cycles of a driving signal SDR when a display brightness is respectively 100% and 50%.
Figure 1C:
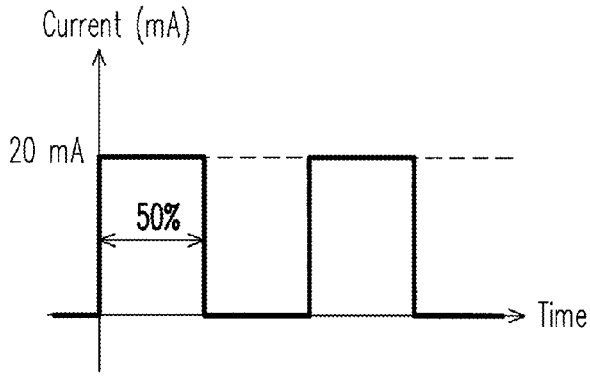

FIG. 1B and FIG. 1C are waveform diagrams of duty cycles of the driving Signal SDR when a display brightness is respectively 100% and 50%. Generally, the brightness of the backlight module is determined by the duty cycle of the driving signal SDR , and the current value of the driving signal SDR is fixed to a predetermined current value (for example, 20 mA). Referring to FIG. 1B, for example, if the display brightness of the backlight module is set to 100%, the current value of the driving signal SDR is 20 mA, and the duty cycle of the driving signal SDR is 100% (i.e. a direct current). Referring to FIG. 1C, if the display brightness of the backlight module is set to 50%, the current value of the driving signal SDR is maintained to 20 mA, and the duty cycle of the driving signal SDR is 50%. In a general state, the current of the driving signal SDR is a fixed value, and when a relationship between the light emitting efficiency and the current of the LED is measured, it is found that when the current is decreased, the light emitting efficiency is increased, and a forward turn-on voltage of the LED is also decreased.

Figure 1D:
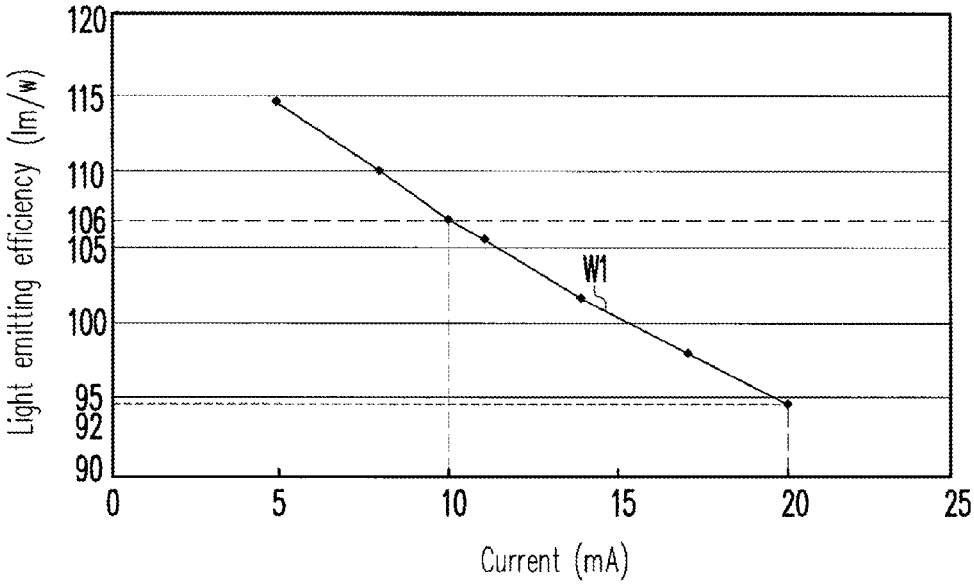
FIG. 1D is a schematic diagram illustrating light emitting efficiencies of a LED corresponding to different current values.
Figure 1E:
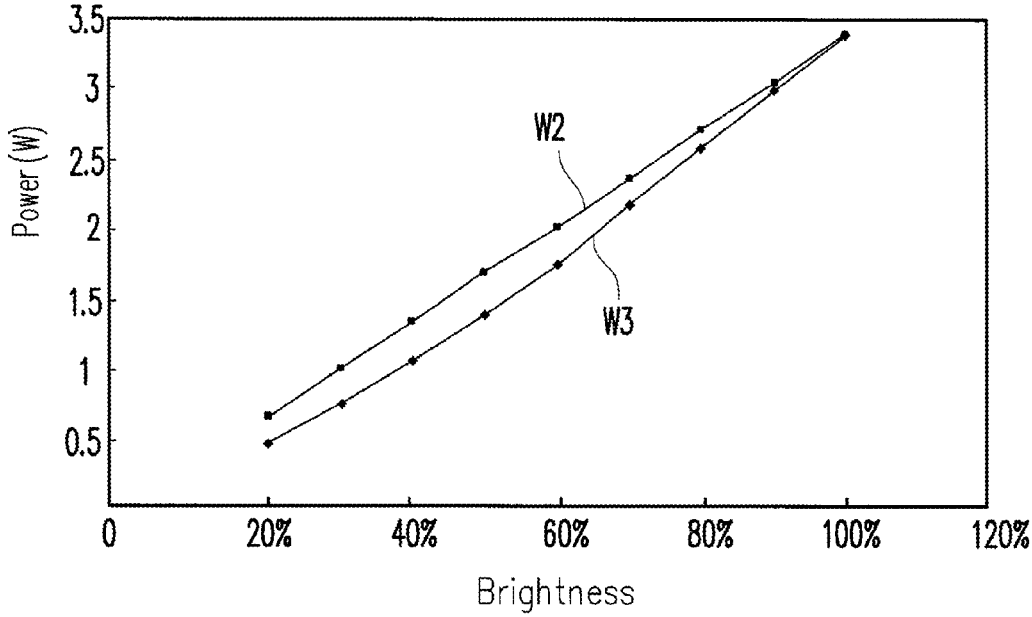
FIG. 1E is a schematic diagram illustrating power consumptions of a LED operated at different brightness of the invention and the conventional pulse width modulation (PWM).

FIG. 1D is a schematic diagram illustrating light emitting efficiencies of the LED corresponding to different current values. Referring to FIG. 1D, a curve W1 is a light emitting efficiency curve of the LED. Taking the curve W1 as an example, when the current value is 20 mA, the light emitting efficiency of the LED is 92 lm/W, and when the current value is 10 mA, the light emitting efficiency of the LED is 106 lm/W. In other words, when the current value is changed from 20 mA to 10 mA, the light emitting efficiency of the LED is increased by 15%. FIG. 1E is a schematic diagram illustrating power consumptions of the LED operated at different brightness of the invention and the conventional PWM. Referring to FIG. 1E, a curve W2 is a power consumption curve of a conventional technique that the brightness is adjusted by adjusting the duty cycle of the driving signal SDR, and a curve W3 is a power consumption curve of the invention that the brightness is adjusted by adjusting the current value of the driving signal SDR. According to the curves W2 and W3, when the same brightness is displayed, the power consumption of the brightness adjusted by adjusting the current value of the driving signal SDR is lower than the power consumption of the brightness adjusted by adjusting the duty cycle of the driving signal SDR. Therefore, by adjusting the current value of the driving signal SDR, the power required for displaying the same brightness is lower than that by adjusting the duty cycle of the driving signal SDR.

Therefore, in the present embodiment, the duty cycle of the second PWM signal PWM2 is fixed to 100%, so that the driving signal SDR is DC-like, and the resistors R1-R9 respectively correspond to current values of different brightness. For example, if 10% of the brightness is taken as an adjusting unit, and an adjusting range is 20%-100%, the brightness corresponding to the resistors R1-R9 are 20%, 30%, 40%, 50%, 60%, 70%, 80%, 90% and 100%. Namely, the signal processing unit 110 generates the corresponding selecting signal SC1 according to the duty cycle of the first PWM signal PWM1, and the driving unit 120 is electrically connected to one of the resistors R1-R9 resistors of the corresponding brightness, and the duty cycle of the correspondingly generated second PWM signal PWM2 is 100%. Variation of the duty cycle of the first PWM signal PWM1 can be adjusted by an user or adjusted due to variation of a system power state, and when the commercial power is used as the power supply, the adjusting range of the brightness is 20%-100%, and when the battery is used as the power supply, the adjusting range of the brightness is 20%-50%.

Moreover, if 1% of the brightness is taken as the adjusting unit, and the adjusting range is 20%-100%, the number of the corresponding resistors is increased to 81, and each resistor corresponding to a different brightness. The driving unit 120 is electrically connected to the resistor corresponding to the duty cycle of the first PWM signal PWM1 according to the selecting signal SC1, so that the LED may present the corresponding brightness. In this way, the brightness can be adjusted by adjusting the current value of the driving signal SDR, so as to reduce the current required for setting the brightness and accordingly save the power consumption.

It should be noticed that in the other embodiments, the signal processing unit 110 can be integrated into a timing controller of a display, and the timing controller can generate the second PWM signal PWM2 and the selecting signal SC1 according to the first PWM signal PWM1, so as to control the duty cycle and the current value of the driving signal SDR generated by the driving unit 120.

Figure 1F:
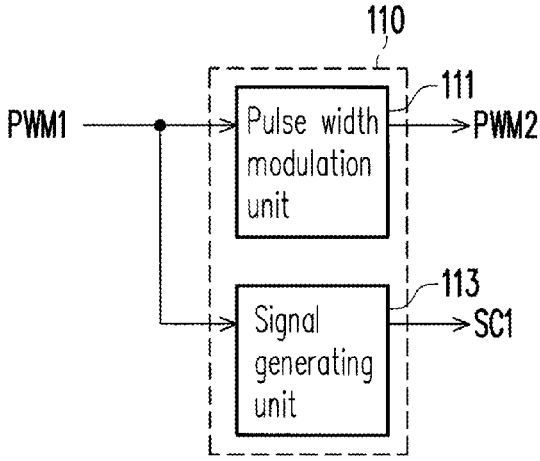
FIG. 1F is a circuit schematic diagram of a signal processing unit 110 of FIG. 1A.

FIG. 1F is a circuit schematic diagram of the signal processing unit 110 of FIG. 1A. Referring to FIG. 1F, in the present embodiment, the signal processing unit 110 includes a PWM unit 111 and a signal generating unit 113. The PWM unit 111 receives the first PWM signal PWM1 to generate the second PWM signal PWM2. The signal generating unit 113 receives the first PWM signal PWM1 to generate the selecting signal SC1. The PWM unit 111 can obtain the duty cycle of the second PWM signal PWM2 according to a look-up table or by performing an operation according to the duty cycle of the first PWM signal PWM1. Similarly, the signal generating unit 113 can also obtain the selecting signal SC1 corresponding to the first PWM signal PWM1 according to the look-up table or by performing an operation according to the duty cycle of the first PWM signal PWM1, where the operation can be performed through an arithmetic logical operation unit.

Figure 2:
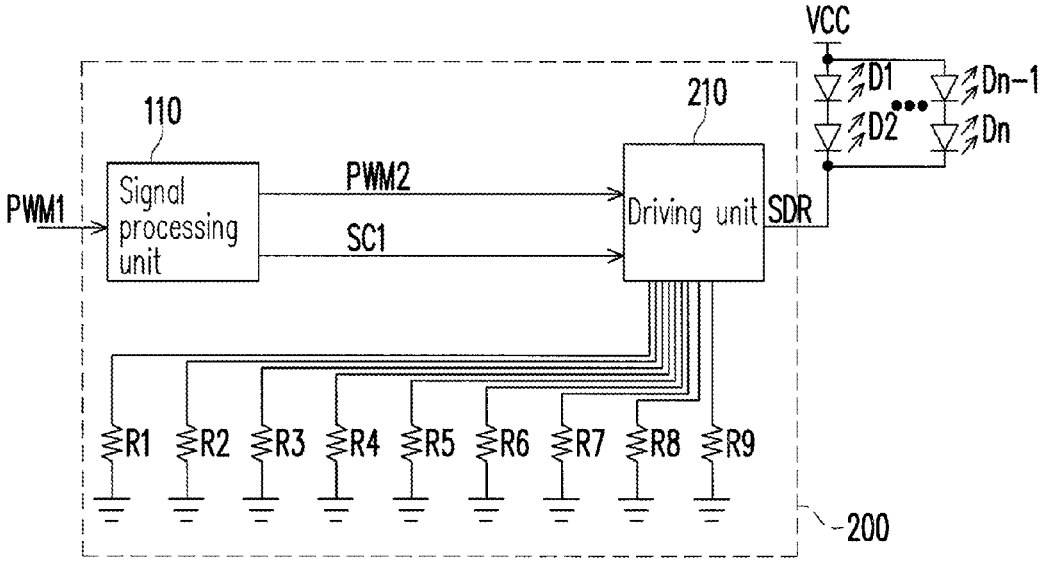
FIG. 2 is a circuit schematic diagram illustrating a LED driving device coupled to LEDs according to a second embodiment of the invention.

FIG. 2 is a circuit schematic diagram illustrating a LED driving device coupled to LEDs according to a second embodiment of the invention. Referring to FIG. 1A and FIG. 2, a difference there between is that the switches SW1-SW9 are integrated into a driving unit 210 of the LED driving device 200, so that the driving unit 210 can select one of the resistors R1-R9 according to the selecting signal SC1 to determine the current value of the driving signal SDR. In this way, the LED is controlled to display the brightness corresponding to the first PWM signal PWM1.

Figure 3:
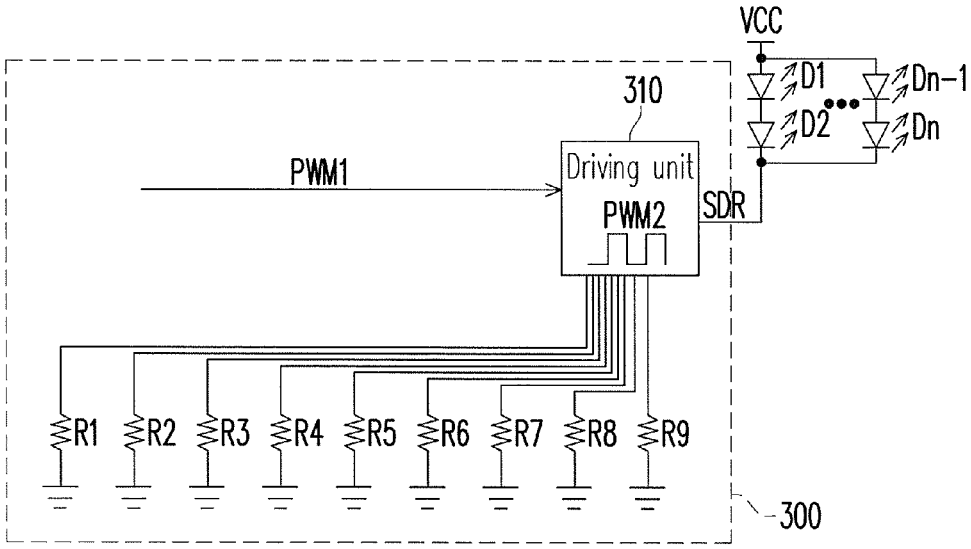
FIG. 3 is a circuit schematic diagram illustrating a LED driving device coupled to LEDs according to a third embodiment of the invention.

FIG. 3 is a circuit schematic diagram illustrating a LED driving device coupled to LEDs according to a third embodiment of the invention. Referring to FIG. 1A and FIG. 3, a difference there between is that the switches SW1-SW9 and the signal processing unit 110 are all integrated into a driving unit 310 of the LED driving device 300, so that the driving unit 310 can select one of the resistors R1-R9 according to the duty cycle of the first PWM signal PWM1 to determine the current value of the driving signal SDR. The driving unit 310 obtains a current value corresponding to the duty cycle of the first PWM signal PWM1 according to the look-up table, and selects one of the resistors R1-R9 corresponding to a current value the same or similar to the above obtained current value. In this way, the driving unit 310 generates the second PWM signal PWM2 according to the first PWM signal PWM1, and takes the duty cycle of the second PWM signal PWM2 as the duty cycle of the driving signal SDR.

Figure 4:
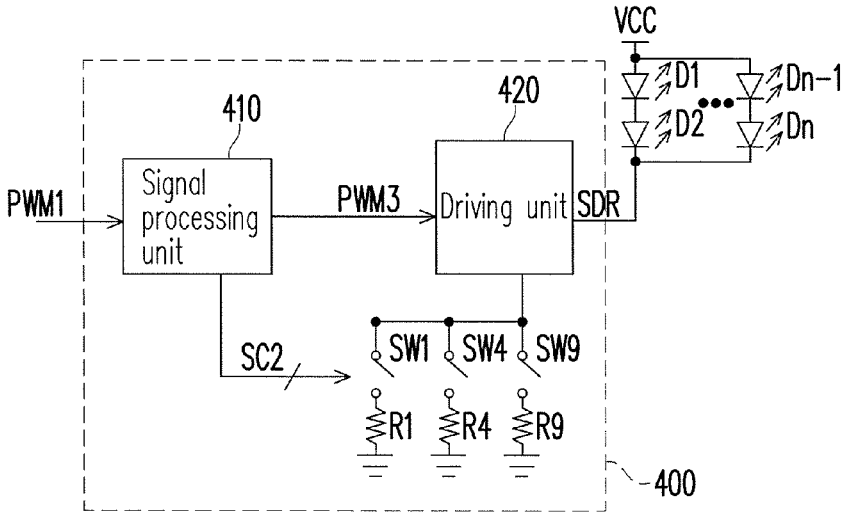
FIG. 4 is a circuit schematic diagram illustrating a LED driving device coupled to LEDs according to a fourth embodiment of the invention.

FIG. 4 is a circuit schematic diagram illustrating a LED driving device coupled to LEDs according to a fourth embodiment of the invention. Referring to FIG. 1A and FIG. 4, in the present embodiment, the LED driving device 400 divides the display brightness into a plurality of sections, and sets the driving signal SDR into different current values according to different brightness sections, where the brightness of each section can be adjusted by adjusting the duty cycle of the driving signal SDR. For example, the display brightness 0%-100% is divided into three sections of 0%-20%, 20%-50% and 50%-100%, and in the section 0%-20%, the current value of the driving signal SDR corresponds to the brightness of 20%, in the section 20%-50%, the current value of the driving signal SDR corresponds to the brightness of 50%, and in the section 50-%100%, the current value of the driving signal SDR corresponds to the brightness of 100%.

Therefore, in the present embodiment, the switches SW1, SW4, SW9 and the resistors R1, R4 and R9 are reserved, and a signal processing unit 410 is similar to the signal processing unit 110, and a driving unit 420 is similar to the driving unit 120. A number and range of the brightness sections can be varied according to an actual design requirement, and in each brightness section, the brightness value corresponding to the current value of the driving signal SDR can be greater than an upper threshold of such brightness section, which can be a brightness value of a better light emitting efficiency. If the duty cycle of the first PWM signal PWM1 is 60%, it represents the brightness to be displayed is 60%. Now, the selecting signal SC2 turns on the switch SW9, so that the current value of the driving signal SDR is still the predetermined current value, and a duty cycle of a third PWM signal PWM3 is also 60%, which is the same to the duty cycle of the first PWM signal PWM1. Therefore, the current value of the driving signal SDR is the predetermined current value, and the duty cycle of the driving signal SDR is 60%.

If the duty cycle of the first PWM signal PWM1 is 40%, it represents that the brightness to be displayed is 40%. Now, the selecting signal SC2 turns on the switch SW4, so that the current value of the driving signal SDR is a current value corresponding to the brightness 50%, and the duty cycle of the third PWM signal PWM3 is 80%, which is twice of the duty cycle of the first PWM signal PWM1. Therefore, the current value of the driving signal SDR is the current value corresponding to the brightness 50%, and the duty cycle of the driving signal SDR is 80%.

If the duty cycle of the first PWM signal PWM1 is 10%, it represents that the brightness to be displayed is 10%. Now, the selecting signal SC2 turns on the switch SW1, so that the current value of the driving signal SDR is a current value corresponding to the brightness 20%, and the duty cycle of the third PWM signal PWM3 is 50%, which is five times of the duty cycle of the first PWM signal PWM1. Therefore, the current value of the driving signal SDR is the current value corresponding to the brightness 20%, and the duty cycle of the driving signal SDR is 50%. According to the above descriptions, a ratio of the duty cycle of the third PWM signal PWM3 and the duty cycle of the first PWM signal PWM1 is inversely proportional to a ratio of the current value of the driving signal SDR and the predetermined current value. Therefore, if the display brightness is smaller than or equal to 50%, since when the current value of the driving signal SDR is lower than the predetermined current, the light emitting efficiency of the LED is increased, the power consumption is decreased.

Figure 5:
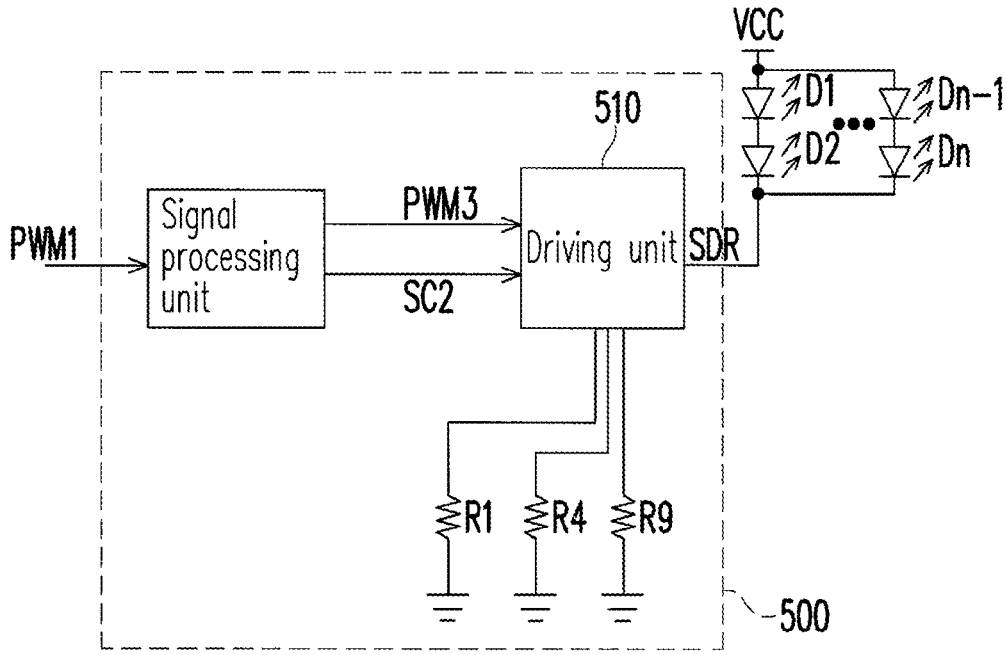
FIG. 5 is a circuit schematic diagram illustrating a LED driving device coupled to LEDs according to a fifth embodiment of the invention.

FIG. 5 is a circuit schematic diagram illustrating a LED driving device coupled to LEDs according to a fifth embodiment of the invention. Referring to FIG. 4 and FIG. 5, a difference there between is that the switches SW1, SW4 and SW9 are integrated into a driving unit 510 of the LED driving device 500, so that the driving unit 510 can select one of the resistors R1, R4 and R9 according to the selecting signal SC2 to determine the current value of the driving signal SDR.

Figure 6:
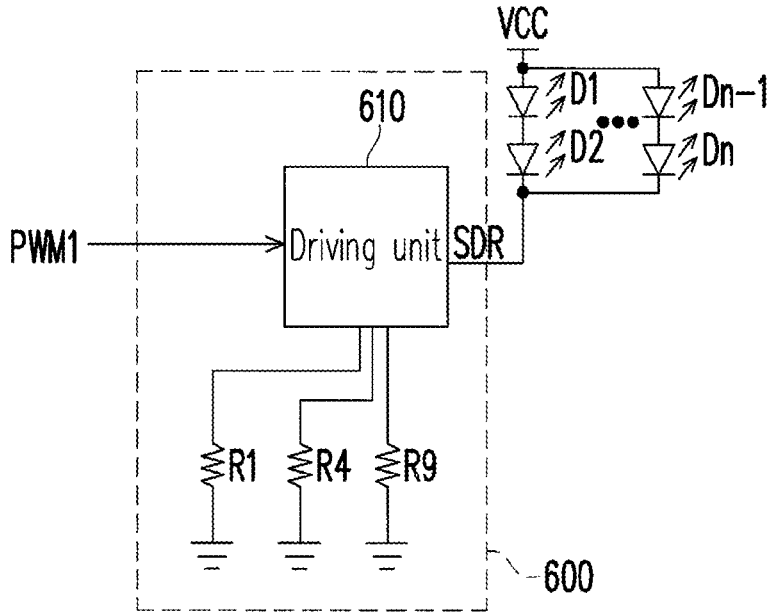
FIG. 6 is a circuit schematic diagram illustrating a LED driving device coupled to LEDs according to a sixth embodiment of the invention.

FIG. 6 is a circuit schematic diagram illustrating a LED driving device coupled to LEDs according to a sixth embodiment of the invention. Referring to FIG. 4 and FIG. 6, a difference there between is that the switches SW1, SW4 and SW9 and the signal processing unit 410 are all integrated into a driving unit 610 of the LED driving device 600, so that the driving unit 610 can select one of the resistors R1, R4 and R9 according to the duty cycle of the first PWM signal PWM1 to determine the current value of the driving signal SDR. The driving unit 610 obtains a current value corresponding to the duty cycle of the first PWM signal PWM1 according to the look-up table, and selects one of the resistors R1, R4 and R9 corresponding to a current value the same or similar to the above obtained current value. Moreover, a ratio of the duty cycle of the driving signal SDR and the duty cycle of the first PWM signal PWM1 is inversely proportional to a ratio of the current value of the driving signal SDR and the predetermined current value.

Figure 7:
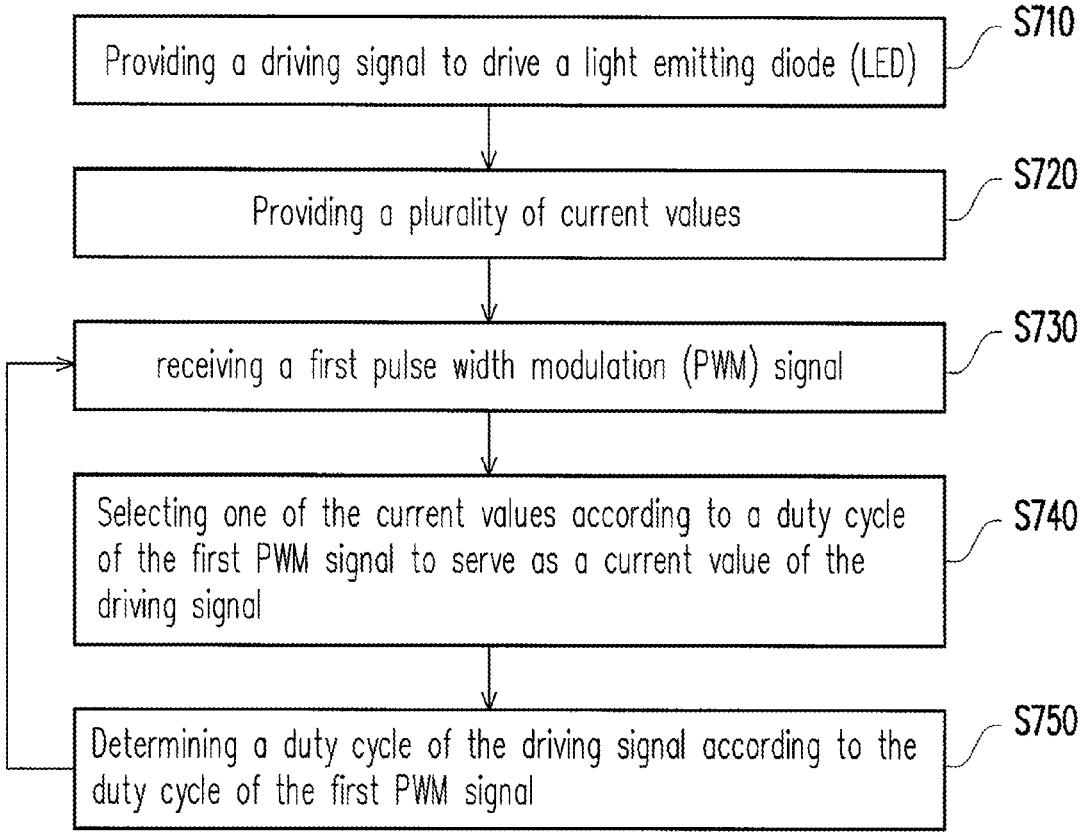
FIG. 7 is a flowchart illustrating a method for driving a LED according to an embodiment of the invention.

According to the above descriptions, a method for driving a LED can be deduced. FIG. 7 is a flowchart illustrating a method for driving a LED according to an embodiment of the invention. Referring to FIG. 7, in the method, a driving signal is provided to drive the LED (step S710), and a plurality of current values is provided (step S720), where the current values correspond to different brightness. Then, a first PWM signal is received (step S730), and one of the current values is selected as a current value of the driving signal according to a duty cycle of the first PWM signal (step S740), and a duty cycle of the driving signal is determined according to the duty cycle of the first PWM signal (step S750). In such method, the steps S730-S750 are continually executed to adjust the current value and the duty cycle of the driving signal according to the temporal first PWM signal. Moreover, descriptions of the LED driving devices 100-600 can be referred for details of each of the steps, and detailed descriptions thereof are not repeated.

In summary, according to the LED driving device and the driving method thereof, since when the current is decreased, the light emitting efficiency of the LED is increased, based on the method that the brightness is adjusted by adjusting the current value of the driving signal, the current required for setting the brightness can be reduced, so as to save the power consumption. Moreover, the display brightness can be divided into a plurality of sections to reduce the number of the selection units coupled to the driving unit.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A light emitting diode (LED) driving device, comprising:

a driving unit, for producing a driving signal to drive a LED; and a plurality of selection units, coupled to the driving unit, and respectively corresponding to different current values, wherein the driving unit selects one of the selection units according a duty cycle of a first pulse width modulation (PWM) signal, and takes a current value corresponding to the selected selection unit as a current value of the driving signal, and the driving unit generates a second PWM signal according to the duty cycle of the first PWM signal, and takes a duty cycle of the second PWM signal as a duty cycle of the driving signal, wherein the duty cycle of the second PWM signal is greater than or equal to the duty cycle of the first PWM signal, wherein a ratio of the duty cycle of the second PWM signal and the duty cycle of the first PWM signal is inversely proportional to the radio of the current value of the driving signal and a predetermined current value.

2. The LED driving device as claimed in claim 1, further comprising:

a plurality of switches, respectively coupled between the selection units and the driving unit, wherein one of the switches is turned on according to a selecting signal, so as to select one of the selection units to electrically connect the driving unit.

3. The LED driving device as claimed in claim 1, wherein the driving unit obtains a current value corresponding to the selecting signal according to a look-up table, and selects one of the selecting units according to the current value corresponding to the selecting signal.

4. The LED driving device as claimed in claim 1, wherein the driving unit obtains a current value corresponding to the duty cycle of the first PWM signal and the duty cycle of the second PWM signal according to a look-up table or an arithmetic logical operation unit, and selects one of the selection units according to the current value corresponding to the duty cycle of the first PWM signal.

5. The LED driving device as claimed in claim 1, wherein the selection units are respectively more than one resistors or registers.

6. A method for driving a light emitting diode (LED), comprising:

providing a driving signal to drive a LED;

providing a plurality of current values;

receiving a first pulse width modulation (PWM) signal;

selecting one of the current values according to a duty cycle of the first PWM signal to serve as a current value of the driving signal;

generating a second PWM signal according to the duty cycle of the first PWM signal, wherein a duty cycle of the second PWM signal is greater than or equal to the duty cycle of the first PWM signal, wherein a ratio of the duty cycle of the second PWM signal and the duty cycle of the first PWM signal is inversely proportional to a ratio of the current value of the driving signal and a predetermined current value; and taking the duty cycle of the second PWM signal as a duty cycle of the driving signal.

7. The method for driving the LED as claimed in claim 6, wherein the step of selecting one of the current values according to the duty cycle of the first PWM signal comprises:

generating a selecting signal according to the duty cycle of the first PWM signal; and selecting one of the current values according to the selecting signal.

8. The method for driving the LED as claimed in claim 7, wherein the step of selecting one of the current values according to the selecting signal comprises:

obtaining a current value corresponding to the selecting signal according to a look-up table; and selecting one of the current values according to the current value corresponding to the selecting signal.

9. The method for driving the LED as claimed in claim 7, wherein the selecting signal is obtained according to a look-up table or is obtained by performing an operation on the duty cycle of the first PWM signal.

10. The method for driving the LED as claimed in claim 6, wherein the second PWM signal is obtained according to a look-up table or is obtained by performing an operation on the duty cycle of the first PWM signal.

11. The method for driving the LED as claimed in claim 6, wherein the step of selecting one of the current values according to the duty cycle of the first PWM signal comprises:

obtaining a current value corresponding to the duty cycle of the first PWM signal according to a look-up table; and selecting one of the current values according to the current value corresponding to the duty cycle of the first PWM signal.

12. A driving device, for driving at least one light emitting diode (LED), comprising:

a pulse width modulation (PWM) unit;

a signal generating unit;

a selection unit, coupled to the signal generating unit; and a current generating unit, coupled to the selection unit, wherein when a brightness of the LED is to be changed, the PWM unit receives a first PWM signal and generates a second PWM signal, and the signal generating unit also receives the first PWM signal and generates a selecting signal, the selection unit receives the selecting signal and generates a current determining signal, the current generating unit receives the current determining signal and generates a driving current, and the driving device drives the LED according to a duty cycle of the second PWM signal and the driving current, wherein a ratio of the duty cycle of the second PWM signal and the duty cycle of the first PWM signal is inversely proportional to the ratio of the driving current and a predetermined current value.

13. The driving device as claimed in claim 12, wherein the selection unit comprises more than one resistors or registers.

14. The driving device as claimed in claim 12, wherein the PWM unit obtains the second PWM signal corresponding to the duty cycle of the first PWM signal according to a look-up table, or generates the second PWM signal by performing an operation on the duty cycle of the first PWM signal.

15. The driving device as claimed in claim 12, wherein the signal generating unit obtains the selecting signal corresponding to the duty cycle of the first PWM signal according to a look-up table, or generates the selecting signal by performing an operation on the duty cycle of the first PWM signal.

* * * * *

UNITED STATES PATENT AND TRADEMARK OFFICE

CERTIFICATE OF CORRECTION

PATENT NO. : 8,638,049 B2
APPLICATION NO. : 13/042957
DATED : January 28, 2014
INVENTOR(S) : Yang et al.

It is certified that error appears in the above-identified patent and that said Letters Patent is hereby corrected as shown below:

Title page, item 54, and in the Specification, column 1, the title should be "Driving Device, Light Emitting Diode Driving Device and Driving Method Thereof"

Signed and Sealed this
Eighth Day of April, 2014

Michelle K. Lee

Michelle K. Lee
*Deputy Director of the United States Patent and Trademark Office*